United States Patent [19]

Suyama

[11] 4,235,304

[45] Nov. 25, 1980

[54] MUFFLER

[75] Inventor: Eizo Suyama, Mitaka, Japan

[73] Assignee: Nihon Radiator Co., Ltd., Tokyo, Japan

[21] Appl. No.: 827,549

[22] Filed: Aug. 25, 1977

[30] Foreign Application Priority Data

| | | | |
|---|---|---|---|
| Aug. 31, 1976 | [JP] | Japan | 51-115747[U] |
| Jan. 18, 1977 | [JP] | Japan | 52-3790[U] |
| Apr. 13, 1977 | [JP] | Japan | 52-45231[U] |
| Apr. 22, 1977 | [JP] | Japan | 52-45899[U] |

[51] Int. Cl.[3] ..... F01N 1/08

[52] U.S. Cl. ..... 181/265; 181/272

[58] Field of Search ..... 181/265, 275, 264, 272, 181/266, 256, 257, 258

[56] References Cited

U.S. PATENT DOCUMENTS

| | | | |
|---|---|---|---|
| 2,928,492 | 6/1954 | Nelson | 181/275 |
| 3,512,607 | 5/1970 | Hubbell | 181/265 |
| 3,724,591 | 4/1973 | Malkiewicz | 181/265 |
| 4,056,934 | 11/1977 | Mizusawa | 181/264 |
| 4,079,810 | 3/1978 | Prather et al. | 181/272 X |
| 4,122,914 | 10/1978 | Suyama | 181/265 X |

*Primary Examiner*—Kenneth J. Ramsey

*Attorney, Agent, or Firm*—Gordon W. Hueschen

[57] ABSTRACT

A muffler comprising: a cylindrical body closed at opposite ends with end members; an exhaust gas in-flow tube penetrating and secured to one of the end members; an exhaust gas out-flow tube penetrating and secured to the other end member; and at least one perforated partition wall member for supporting both the tubes and dividing the interior of the body; the exhaust gas in-flow tube at least having an end portion of an inner diameter smaller than the inner diameter of an exhaust tube connected to the exhaust gas in-flow tube, the end portion being closed with a porous body and communicating with one of the sections of the body interior through the porous body; the exhaust gas outflow tube being open at opposite ends, one of the ends communicating with the other section; and at least one of the tubes being formed in the peripheral wall with a shunting hole.

10 Claims, 6 Drawing Figures

MUFFLER

BACKGROUND OF THE INVENTION

1. Field of the Invention

This invention relates to a muffler and, more particularly, to a muffler for muffling exhaust sound of an internal combustion engine or the like and which is simple in construction and has excellent muffling efficiency.

Attention is invited to my application Ser. No. 789,917, filed Apr. 22, 1977, now U.S. Pat. No. 4,122,914, issued Oct. 31, 1978, of which the present invention is an improvement.

2. Prior Art

Hitherto, various types of muffler to be provided in the automotive exhaust gas system for attenuating the exhaust noise have been proposed. For example, it has been in practice to insert exhaust gas in-flow and out-flow tubes in a cylindrical or elliptical barrel and also provide partition walls and shunting holes within the barrel for uniformalizing the pulsation pressure introduced into the muffler. However, such a muffler has provided an insufficient muffling effect.

Also, it has been known that when mounting a muffler on an exhaust tube a difference is produced in the muffling effect depending upon the position of mounting. However, where the muffler is mounted on the underside of an automobile, particularly where it has to be installed in a limited space as in a passenger car, it can not always be installed in an optimum position, and also sometimes it is inadequate for installation in a position of sufficient muffling effect. The optimum mounting position for mounting the muffler is determined as functions of the effective length and sectional area of the inlet side exhaust gas tube, the effective length and sectional area of the muffler body and the effective length and area of the outlet side exhaust gas tube. Depending upon the construction of the underside of the floor of an automobile, the optimum mounting place can not always be obtained where limitations are imposed upon the place of installation of the muffler.

OBJECTS OF THE INVENTION

An object of the present invention, accordingly, is to provide a novel muffler.

Another object of the present invention is to provide a muffler, which is excellent in the muffling performance and has a novel construction free from generation of secondary noise.

A further object of the present invention is to provide a muffler, which can provide practically the same effects as would be obtained if it were installed in the optimum position even in the case where it can not be installed in an adequate position.

SUMMARY OF THE INVENTION

The above objects according to the present invention are achieved by a muffler comprising a cylindrical body closed at the opposite ends with end members, an exhaust gas in-flow tube penetrating and secured to one of the end members, an exhaust gas out-flow tube penetrating and secured to the other end member, and at least one perforated partition wall for supporting both the tubes within the body and dividing the interior of the body into sections or compartments, said exhaust gas in-flow tube at least having an end portion of a diameter smaller than the inner diameter of the exhaust tube connected to it, said end portion being closed with a porous member and communicated with the adjacent section via the porous member, said exhaust gas out-flow tube being open at the opposite ends, one of these ends being communicated with the adjacent section or compartment, and at least one of said tubes being provided at the tube wall with a shunting hole.

Accordingly, according to the invention it is possible to obtain a muffler, which is simple in construction and has sufficient muffling effects.

BRIEF DESCRIPTION OF THE INVENTION

DETAILED EXPLANATION OF THE INVENTION

Figure 1:
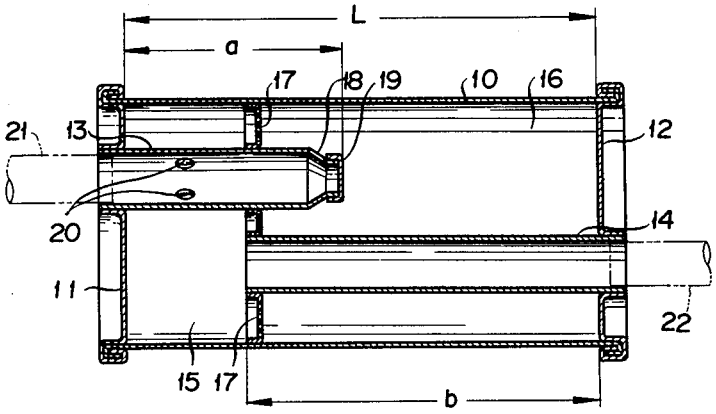
FIG. 1 is a longitudinal sectional view showing an embodiment of the muffler in accordance with the present invention.

FIG. 1 shows an embodiment in accordance with the present invention. A cylindrical body 10 is closed at the opposite ends with respective end members 11 and 12 by such method as fastening along the edge. An exhaust gas in-flow tube 13 and an exhaust gas out-flow tube 14 penetrate the respective end members 11 and 12 and extend through the interior of the body, and they also penetrate and are supported by a perforated partition wall member 17 dividing the interior of the body into two sections 15 and 16. In this way, both the tubes 13 and 14 are secured in position. The in-flow tube 13 is provided with a reduced diameter section 18 projecting into the section 16, with a cap 19 of a heat-resistant continuous porous body, for instance a foamed metal or metal net. The in-flow tube 13 is provided in its wall portion within the section 15 with shunting holes 20. The out-flow tube 14 is open at the opposite ends, with its one end open to and communicating with the section 15. Thus, the in-flow tube 13 communicates with the out-flow tube 14 mainly through the section 16, the perforated wall member 17 and the section 15.

The ratio of the length a of the in-flow tube 13 extending within the body to the length b of the out-flow tube 14 extending within the body is preferably set to a:b=0.625 or 1.5. The area of the shunting holes 20 is preferably equivalent to a range of four holes with a diameter of 2 mm to two holes with a diameter of 6 mm when the in-flow tube has a diameter of 40 mm.

The in-flow and out-flow tubes 13 and 14 are connected to respective exhaust tubes 21 and 22. When automotive engine exhaust gas from an exhaust tube 21 is supplied into the muffler, the pressurized exhaust gas in a pulsating state is throttled in the reduced diameter portion 18 at the end of the in-flow tube 13, then it is dispersed as minute gas streams as it passes through the pores of the continuous porous body 19, and then it flows into the section 16 and is expanded therein. Subsequently, it passes through the perforated partition wall member 17 to enter into the section 15, and then it is discharged through the out-flow tube 14 into the exhaust tube 22. Meanwhile, part of the exhaust gas entering the in-flow tube 13 directly enters through the shunting holes 20 into the section 15, thereby preventing the increase of engine back pressure due to the resistance offered as the exhaust gas passes through the continuous porous body 19 while effecting muffling due to expansion of the exhaust gas in the section 15 and muffling due to interference with respect to the exhaust gas advancing through the partition member 17 into the section 15. The perforated partition wall member 17 has an effect of attenuating noise produced as the exhaust gas passes through the continuous porous body 19. As heat-resistant continuous porous body 19 may be suitably used a foamed metal which is obtained by rendering a metal into a porous state.

As has been shown, the exhaust gas proceeds through the muffler while it is given such effects as throttling, resistance application, expansion and interference, and it is possible to sufficiently attenuate the sound pressure and increase the muffling effect by appropriately determining the lengths of in-flow and out-flow tubes 13 and 14 and the size of the shunting holes 20 as mentioned earlier. The muffling effect varies depending upon the position of installation of the muffler on the exhaust tube, by adjusting the position of the shunting holes 20 along the longitudinal direction of the in-flow tube 13 it is possible to vary the actual position of mounting of the muffler so as to increase the muffling effect.

Figure 2:
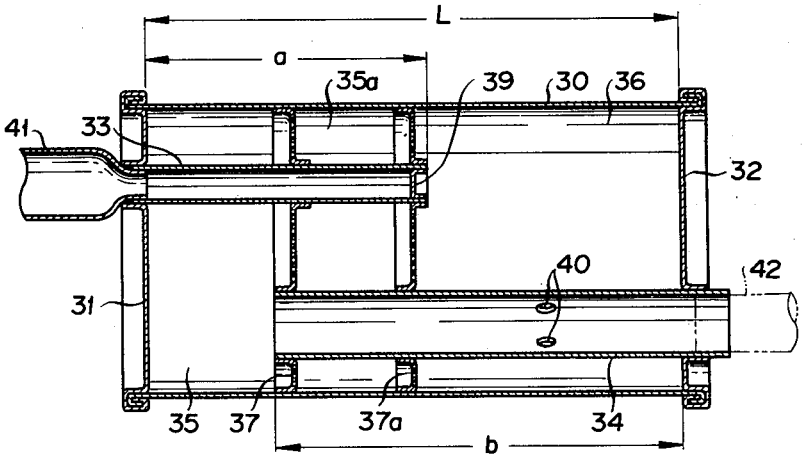
FIG. 2 is a longitudinal sectional view showing another embodiment in accordance with the present invention.

FIG. 2 shows another embodiment of the invention. A cylindrical body 30 is closed at the opposite ends with respective end members 31 and 32. An exhaust gas in-flow tube 33 and an exhaust gas out-flow tube 34 penetrate the respective end members 31 and 32 and extend through the interior of the body, and they also penetrate and are supported by two perforated partition wall members 37 and 37*a* dividing the interior of the body into three sections 35, 35*a* and 36. In this way, both the tubes are secured in position. The in-flow tube 33 has a smaller diameter than the exhaust tube 41, and it is provided at its inner end with a heat-resistant porous body 39 of a cap-like form as mentioned earlier and securedly fitted on the inner end. The out-flow tube is provided in its wall extending in the section 36 with shunting holes 40. The in-flow tube 33 communicates with the out-flow tube 34 mainly through the section 36, partition wall 37*a*, section 35*a*, partition wall 37 and section 35.

The ratio of the length a of the in-flow tube 33 extending within the body to the length b of the out-flow tube 34 within the body, with the length of the body set to 30, is determined in the manner as described in connection with the embodiment of FIG. 1, and also the area of the shunting holes 40 is determined similar to the case of FIG. 1.

The engine exhaust gas having flown through the exhaust tube 41 is dispersed as fine streams into the section 36 mainly by the throttling action of the small-diameter in-flow tube 33 and the resistance offering action of the porous body 19, then the noise of stream generation is attenuated or removed as it passes through the perforated partition members 37*a* and 37 before entering the section 35, and after attenuation of noise it is discharged through the out-flow tube 34 and exhaust tube 42. Meanwhile, part of the exhaust gas is discharged from the section 36 through shunting holes 40 into the exhaust tube 42 with the noise attenuated by the throttling and interference effects given to it as it passes through the holes 40. Similar to the case of FIG. 1, the actual position of mounting of the muffler can be varied by varying the position of the shunting hole 40.

Figure 3:
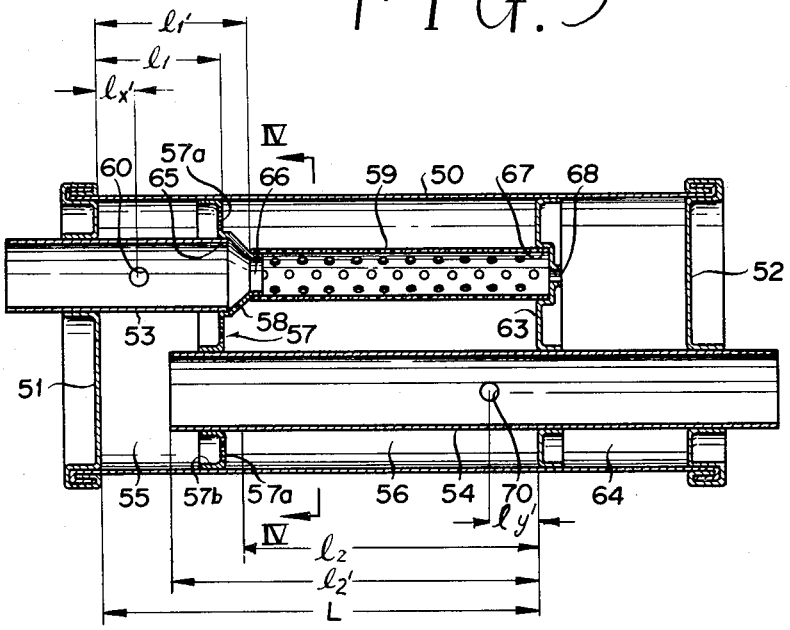
FIG. 3 is a longitudinal sectional view showing a further embodiment in accordance with the present invention.
Figure 4:
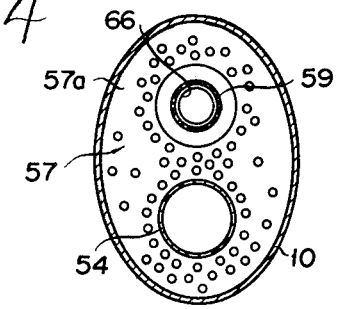
FIG. 4 is a sectional view taken along line IV—IV in FIG. 3.
Figure 5:
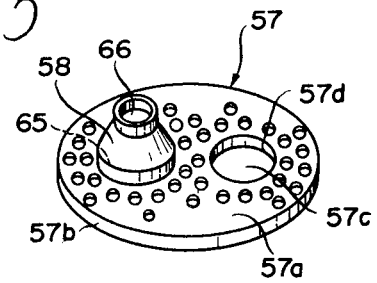
FIG. 5 is a perspective view showing the partition wall member shown in FIG. 3.

FIGS. 3 to 5 show a further embodiment of a muffler in accordance with the present invention. A cylindrical body 50 is closed at the opposite ends with respective end members 51 and 52 by such method as fastening along the edge. An exhaust gas in-flow tube 53 and exhaust gas out-flow tube 54 penetrate the respective end members 51 and 52 and extent through the interior of the body. The interior of the body 50 is divided by a perforated partition wall 57 and partition wall 63 into a first expansion chamber 55, a second expansion chamber 56 and a resonant chamber 64 for resonance with respect to the second expansion chamber 56. The perforated partition wall 57, as shown in FIG. 5, comprises a plate portion 57*a* made of a perforated plate 57*a* and provided with a flame 57*b* for insertion into the body 2 and also with a recessed portion 65 terminating in a tapering portion 58 terminating in an outlet portion 66, these portions being free from holes. It is further provided with an out-flow tube insertion hole 57*c* and a support flange portion 57*d* formed around the hole 57*c*. The tapering portion 58 serves to cover the inner end of the in-flow tube 53, so that its inner diameter is made smaller than the inner diameter of the in-flow tube. This is made so to the end of increasing the ratio of expansion of exhaust gas issuing from the in-flow tube 53 into the muffler. The other partition wall 63 is made of a plate free from holes. It is provided with a recessed portion 67, which is provided with a small throttling hole 68 smaller in the inner diameter than the muffler tube 59 as will be described later, the muffler tube 59 and resonant chamber 64 are communicated with each other via the throttling hole 59.

The in-flow tube 53 has one end portion penetrating the end plate 51 and its inner end fitted in and secured to the recessed portion 65 of the perforated partition wall 57. The out-flow tube 54 has its inner end open to the first expansion chamber 55, and it penetrates and is supported by both partition walls 57 and 63 and end member 52. Fitted on the open end 66 of the tapering portion 58 in communication with the inner end of the in-flow tube 53 is a muffling tube 59 comprised of a perforated tube, foam metal or other continuous porous body, and the other end of the muffling tube is fitted in and supported by the recessed portion 67 formed in the partition wall. The in-flow tube 53 is formed with a shunting hole 60, and the out-flow tube is formed with a shunting hole 70.

With this construction, a major proportion of the engine exhaust gas flowing into the in-flow tube 53 is compressed in volume by the tapering portion 58 to suppress pulsation of the exhaust gas, and thus it flows from the throttling portion 58 into the muffling tube 59 with a great expansion ratio. Part of the exhaust gas tube 53 flows through the shunting hole 60 formed in the tube 53 into the first expansion chamber 55, thus preventing the pressure loss due to pressure reduction in the throttling portion 58 while also effecting muffling due to interference with respect to the exhaust gas flowing into the first expansion chamber 55. Part of the exhaust gas flowing into the muffler tube 59 flows through a path bent at right angles, and it receives the muffling effect by the expansion and contraction of the flow path as it flows through the perforated portion of the tube 59 before entering the second expansion chamber 56 for expansion. Part of the exhaust gas passing through the muffling tube 59 enters through the throttling hole 68 into the resonant chamber 64 to receive the effect of muffling by resonance. At this time, the diameter of the throttling hole 68 is adapted to be varied to vary the resonant frequency within the resonant chamber 64 for obtaining the most effective muffling.

As it passes through the perforated portion of the plate portion of the partition wall 57 from the second expansion chamber 56, the exhaust gas flows in a compressed state from the first expansion chamber 55 into the out-flow tube 54 and receives interference sound within the out-flow tube with respect to the exhaust gas flowing through the shunting hole 70 from the second expansion chamber 56, whereby it is exhausted after being sufficiently muffled.

It will be understood from each of the above embodiments that the muffler in accordance with the present invention can provide various muffling effects to reliably attenuate the exhaust sound with simple construction, and also the partition wall can be simply produced through a mere pressing process, thus permitting reduction of manufacturing cost. Thus, various great practical effects are obtained.

In the muffler of FIG. 3, denoting the length of the muffler body by L, the acoustical effective lengths of insertion of the in-flow and out-flow tubes 53 and 54 into the muffler body by $l_1$ and $l_2$ and the acoustical effective length of insertion of the in-flow and out-flow tubes 53 and 54 into the muffler in case of absence of the shunting holes 60 and 70 by $l_1'+l_2'$ and assuming that the shunting hole is formed at a position of distance $l_x'$ and $l_y'$ from the end of the muffler, $l_1$ and $l_2$ are obtained from the equations $$l_1 = \left(1 - \frac{k}{1 + e^{a-b\cdot\left(\frac{l_1'-l_x'}{l_1'}\right)}}\right) \times l_1'$$

$$l_2 = \left(1 - \frac{k}{1 + e^{a-b\cdot\left(\frac{l_2'-l_y'}{l_2'}\right)}}\right) \times l_2'$$

(where k=0.3160, a=2.8539 and b=7.0991), and it is desirable to form the shunting holes 60 and 70 at positions at which $l_1$ or $l_2$ is $\frac{1}{4}$ L, $\frac{1}{2}$ L or $\frac{3}{4}$ L. These shunting holes may be provided in both in-flow or out-flow tubes 53 and 54 or in either one of them.

Figure 6:
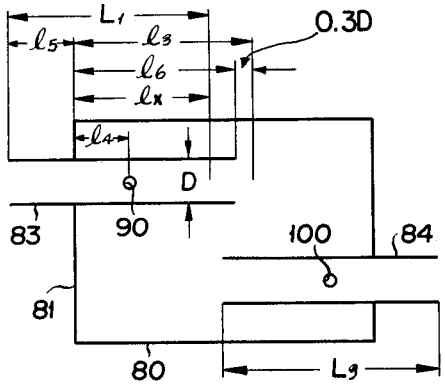
FIG. 6 is a schematic view showing principles underlaying a muffler in accordance with the present invention.

FIG. 6 is a schematic view illustrating the principles of the structure of the muffler in accordance with the present invention. Without the shunt hole 90, the acoustical effective length of the exhaust gas in-flow tube 83 up to an end member 81 of the muffler body 80, as shown in FIG. 6, is represented by $l_5+l_6+0.3D$.

By forming a shunting hole 90 in the body 80 extending within the in-flow tube 83 at a position of distance $l_4$ from the end member 81, the acoustical effective length $l_x$ of insertion of the exhaust gas in-flow tube 83 into the body 80 is given as $$l_x = \left(1 - \frac{k}{1 + e^{a-b\cdot\left(\frac{l_3-l_4}{l_3}\right)}}\right) \times l_3$$

(where k=0.3160, a=2.8539, b=7.0991, and $l_3=l_6+0.3D$). From this equation the modified acoustical effective length $L_1$ of the exhaust gas in-flow tube 83 is obtained as $$L_1 = l_5 + l_x = l_5 + \left(1 - \frac{k}{1 - e^{a-b\cdot\left(\frac{l_3-l_4}{l_3}\right)}}\right) \times l_3$$

Since $l_4$ can be freely varied within a range of $0<l_4<l_6$, by adjusting the position of forming the shunting hole the acoustical effective length $L_1$ of the in-flow tube 83 can be varied. As for the exhaust gas out-flow tube 84, the acoustical effective length $L_3$ can be similarly varied by forming a shunt hole 100.

Our researches have proved that when the exhaust gas in-flow tube is made as a circular tube with an inner diameter of 40.3 mm, the above end can be achieved by forming one or more shunting holes with the total area of 25 to 300 $mm^2$. The fact that the effective length of the exhaust gas in-flow tube (or out-flow tube) can be varied by providing the shunting hole 90 means that in case of using the same type of muffler the body 80 can be mounted near the inlet side by providing the shunting hole.

Quite the same principles are applied to the exhaust gas out-flow tube as well. Thus, in the long run by the provision of the shunting hole 100 the muffler can be installed nearer either inlet side or outlet side by varying the length of in-flow or out-flow tubes 83 and 84.

Accordingly, in case when mounting the muffler on the underside of the vehicle body, even if the best position of mounting can not be obtained due to the vehicle structure, sufficient muffling effect can be obtained by installation in an appropriate position and through adjustment of the shunting hole.

As has been shown, with the muffler according to the invention the muffler position capable of obtaining the best muffling effect can be shifted toward the inlet side or outlet side by providing the exhaust gas in-flow or out-flow tubes 83 and 84 with the shunting hole 90 or 100. Thus, sufficient muffling effect can be obtained even in case the mounting position has to be altered due to the vehicle structure.

The tolerance of the position of installation of muffler is about ±200 mm, and with this order of change of position the muffling effect will not be extremely reduced.

I claim:

1. A muffler having an exhaust gas in-flow tube adapted to be connected to an exhaust supply tube comprising:

a cylindrical body closed at opposite ends with end members;

said exhaust gas in-flow tube penetrating and being secured to one of said end members;

an exhaust gas out-flow tube penetrating and secured to the other end member; and at least one perforated partition wall member for supporting both said tubes and dividing the interior of said body into sections;

said exhaust gas in-flow tube having an end portion closed with a porous body and communicating with one of the sections of the body interior through said porous body;

said exhaust gas out-flow tube being open at opposite ends, one of said ends communicating with another said section of the body interior;

at least one of said exhaust gas in-flow and out-flow tubes being provided in the peripheral wall thereof with a shunting hole; and said exhaust gas in-flow tube communicating with the interior of said muffler exclusively through said porous body and any shunting hole provided in the peripheral wall of said exhaust gas in-flow tube; wherein said exhaust gas in-flow tube is provided with a reduced-diameter throttling portion closed with said porous body comprised of a heat-resistant, continuous, porous cap fitted on said reduced-diameter portion.

2. A muffler according to claim 1, wherein said exhaust gas in-flow tube has a shunting hole.

3. A muffler according to claim 1, wherein said continuous porous body is a foamed metal.

4. A muffler according to claim 3, wherein the ratio of the length a of the portion of said exhaust gas in-flow tube extending in the body to the length b of the portion of said exhaust gas out-flow tube extending in the body is a:b equals 0.667 or 1.5.

5. A muffler according to claim 1, wherein said continuous porous body is a metal net.

6. A muffler having an exhaust gas in-flow tube adapted to be connected to an exhaust supply tube comprising:

a cylindrical body closed at opposite ends with end members;

said exhaust gas in-flow tube penetrating and being secured to one of said end members;

an exhaust gas out-flow tube penetrating and secured to the other end member; and at least one perforated partition wall member for supporting both said tubes and dividing the interior of said body into sections;

said exhaust gas in-flow tube having an end portion closed with a porous body and communicating with one of the sections of the body interior through said porous body;

said exhaust gas out-flow tube being open at opposite ends, one of said ends communicating with another said section of the body interior;

at least one of said exhaust gas in-flow and out-flow tubes being provided in the peripheral wall thereof with a shunting hole; and said exhaust gas in-flow tube communicating with the interior of said muffler exclusively through said porous body and any shunting hole provided in the peripheral wall of said exhaust gas in-flow tube; which includes only one perforated partition wall member, which further includes a non-perforated partition wall member; and wherein said porous body is disposed in a section between said perforated partition wall member and said non-perforated partition wall member and comprises a perforated muffling tube which is coupled to and is of a smaller inner diameter than the inner diameter of said exhaust gas in-flow tube.

7. A muffler having an exhaust gas in-flow tube adapted to be connected to an exhaust supply tube comprising:

a cylindrical body closed at opposite ends with end members;

said exhaust gas in-flow tube penetrating and being secured to one of said end members;

an exhaust gas out-flow tube penetrating and secured to the other end member; and at least one perforated partition wall member for supporting both said tubes and dividing the interior of said body into sections;

said exhaust gas in-flow tube having an end portion closed with a porous body and communicating with one of the sections of the body interior through said porous body;

said exhaust gas out-flow tube being open at opposite ends, one of said ends communicating with another said section of the body interior;

at least one of said exhaust gas in-flow and out-flow tubes being provided in the peripheral wall thereof with a shunting hole; and said exhaust gas in-flow tube communicating with the interior of said muffler exclusively through said porous body and any shunting hole provided in the peripheral wall of said exhaust gas in-flow tube; which includes only one perforated partition wall member, which further includes a non-perforated partition wall member, wherein said perforated partition wall member comprises a plate portion made of a perforated plate and provided with a recessed portion terminating in a tapering portion terminating in an open portion, these portions being free from holes.

8. A muffler according to claim 7, wherein said exhaust gas in-flow tube has an inner end received in the recessed portion of said perforated partition wall member, wherein said porous body comprises a perforated muffling tube which has an end fitted on the open end of the tapering portion of said perforated partition wall member and the other end supported by said non-perforated partition wall member, and wherein said exhaust gas out-flow tube penetrates and is secured to the other end member, the perforated partition wall member, and the non-perforated partition wall member.

9. A muffler according to claim 8, wherein said muffling tube has its open inner end occupying said non-perforated partition wall member.

10. In combination with an exhaust gas supply tube, a muffler having an exhaust gas in-flow tube adapted to be connected to an exhaust supply tube comprising:

a cylindrical body closed at opposite ends with end members;

said exhaust gas in-flow tube penetrating and being secured to one of said end members;

an exhaust gas out-flow tube penetrating and secured to the other end member; and at least one perforated partition wall member for supporting both said tubes and dividing the interior of said body into sections;

said exhaust gas in-flow tube having an end portion closed with a porous body and communicating with one of the sections of the body interior through said porous body;

said exhaust gas out-flow tube being open at opposite ends, one of said ends communicating with another said section of the body interior;

at least one of said exhaust gas in-flow and out-flow tubes being provided in the peripheral wall thereof with a shunting hole, and said exhaust gas in-flow tube communicating with the interior of said muffler exclusively through said porous body and any shunting hole provided in the peripheral wall of said exhaust gas in-flow tube; wherein said exhaust gas in-flow tube has a smaller diameter than said exhaust gas supply tube, thus providing a reduced-diameter throttling portion closed with said porous body comprised of a heat-resistant, continuous, porous cap fitted on said reduced-diameter portion.

* * * * *

UNITED STATES PATENT AND TRADEMARK OFFICE

CERTIFICATE OF CORRECTION

PATENT NO. : 4,235,304

DATED : November 25, 1980

INVENTOR(S) : Eizo Suyama

It is certified that error appears in the above-identified patent and that said Letters Patent are hereby corrected as shown below:

[56] References Cited, U.S. PATENT DOCUMENTS,
line 1; "6/1954" should read -- 3/1960
line 2; "Hubbell" should read -- Hubbell III --
line 4; "Mizusawa" should read -- Mizusawa et al. --

Col. 2, line 58; "0.625" should read -- .667 --

Col. 4, line 22; "flame" should read -- flange --

Signed and Sealed this

Seventh Day of July 1981

[SEAL]

Attest:

RENE D. TEGTMEYER

Attesting Officer

Acting Commissioner of Patents and Trademarks